United States Patent [19]

O'Brien

[11] Patent Number: 4,604,601

[45] Date of Patent: Aug. 5, 1986

[54] ELECTRIC PLUG FUSE WITH CORRUGATED ELEMENT

[75] Inventor: Terry R. O'Brien, Brampton, Canada

[73] Assignee: Gould Inc., Rolling Meadows, Ill.

[21] Appl. No.: 760,365

[22] Filed: Jul. 30, 1985

[51] Int. Cl.[4] ..... H01H 85/16

[52] U.S. Cl. ..... 337/261; 337/255; 337/260

[58] Field of Search ..... 337/260, 261, 262, 255, 337/268, 252, 232

[56] References Cited

U.S. PATENT DOCUMENTS 2,527,160 10/1950 Taylor ..... 337/261

4,386,335 5/1983 O'Brien ..... 337/261

*Primary Examiner*—Harold Broome

*Attorney, Agent, or Firm*—Frederick A. Goettel, Jr.

[57] ABSTRACT

An electric plug fuse of the type wherein one end of the fusible element is retained in a channel between the insulating body of the fuse and an outer metal shell is provided with a geometrically configured fusible element which allows extremely thin elements to be used while maintaining a high level of structural and electrical integrity in the fuse.

3 Claims, 4 Drawing Figures

ELECTRIC PLUG FUSE WITH CORRUGATED ELEMENT

BACKGROUND OF THE INVENTION

1. Field of the Invention

The present invention relates to electric plug type fuses. More specifically, it relates to a construction which assures a high level of structural and electrical integrity of plug type fuses, while permitting use of fusible elements substantially thinner than heretofore used.

2. Description of the Prior Art

Electric plug type fuses typically include a cylindrical hollow glass body which defines an internal cavity and which are provided with screw threads on the outer surface thereof. A contact button support made from an electric insulating material has one end projecting into the internal cavity of the glass body and the other end extends to the outside thereof. A contact button is carried on the outer end of the contact button support. A metal outer shell overlaps the contact button support and is provided with screw threads which mate with the screw threads on the glass body thereby allowing the metal shell to be threadably engaged with the glass body and to retain the contact button support in position with respect to the glass body. The glass body is provided with a groove on the outer surface which extends perpendicular to and interrupts the screw threads formed on the glass body. This groove and the outer metal shell cooperate to define a channel between them. The fusible element of such plug fuses is formed from a strip like conductive material and has one end thereof conductively connected to the contact button inside the fuse and extends from that connection into the cavity defined by the glass body. From there the fusible element extends in between the contact support and the glass body and into the channel defined by the groove and the metal shell. The end of the fusible element extending into this groove is soldered to the metal shell to complete the electrical path of the fuse.

With prior art fuse designs, the fusible element was relatively thick, for example in the neighborhood of twelve thousandths of an inch thick. This relatively thick element provided a good mechanical interlock between the glass body and the outer metal shell when the element was fitted into the groove there between and soldered to the outer shell. More recent designs of plug type fuses incorporate much thinner element material, for example, five thousandths of an inch thick is not uncommon. Thinner elements do not provide as strong of an interlock between the hollow glass body and the outer metal shell as designs using thicker elements. This has resulted in a number of problems with use of thin elements in such fuses.

Electric plug fuses are installed into a fuse holder by screw threading the threads on the metal shell into engagement with mating metal threads in an appropriate fuse holder. During installation the glass body is held by the installer in order to impart the necessary rotation to the fuse to effect installation. During such installation the clockwise force imparted on the glass body is transferred to the metal shell by way of the groove in the glass body, the fusible element contained in the groove and the solder connection interconnecting the fusible element with the metal shell. Installation of a new fuse in a fuse holder normally does not exert a great force on this interconnection.

When an electric plug fuse has blown and it is necessary to remove the fuse from the fuse holder, however, the force necessary to remove the fuse is usually far greater than that necessary for installation of the fuse. Such is the case in particular when a fuse has been installed in a holder for an extended period of time. During removal of a blown fuse, the counterclockwise rotational force imparted on the glass body is again transferred to the metal shell by way of the mechanical interconnection between the groove in the glass body, the fusible element, and the solder joint between the fusible element and the screw shell. Under such circumstances, however, the resistance of the metal shell to rotation often results in a force upon the above described interconnection which results in failure of the connection. Such failure results in the fusible element passing out of the groove and into the region between the threaded glass body and the metal shell. In designs using a thin fusible element, it has happened that when removing a fuse from its fuse holder, the inteconnection has failed completely and the glass body has been turned out of the metal screw shell leaving the remaining element, the insulating tip and the center contact in the fuse holder, thus resulting in an extremely hazardous condition.

SUMMARY OF THE INVENTION

The present invention relates to electric plug type fuses of the type described hereinabove in the Background of the Invention which allows fusible elements made from relatively thin sheet stock to achieve a high strength mechanical interconnection between the hollow glass body and the outer metal shell without making substantial alterations to the relatively simple structure of such a fuse other than to one end of the fusible element itself.

Accordingly, the principle novel feature of this invention is to form the end of the fusible element which extends into the channel defined between the hollow glass body and the outer screw shell into a geometric shape which defines a plurality of substantially separate longitudinally extending solder receiving cells in the channel in the region thereof between the fusible element and the metal shell. In the preferred embodiment, the end of the fusible element is formed into a W-shape and in another embodiment a V-shape may be used.

BRIEF DESCRIPTION OF THE DRAWINGS

The novel features that are considered characteristic of the invention are set forth with particularity in the appended claims. The invention itself, however, both as to its organization and its method of operation, together with additional objects and advantages thereof, will best be understood from the following description of the preferred embodiment when read in connection with the accompanying drawings wherein like numbers have been employed in the different figures to denote the same parts and wherein:

DESCRIPTION OF THE PREFERRED EMBODIMENTS

Figure 1:
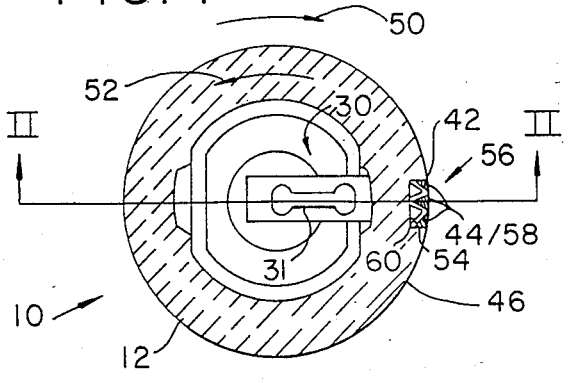
FIG. 1 is a horizontal section through a fuse according to the present invention.
Figure 2:
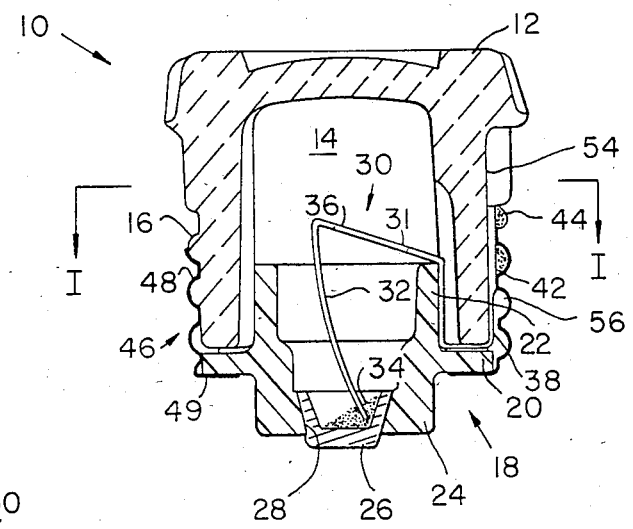
FIG. 2 is a section taken along the line II—II of FIG. 1.

Referring now to FIGS. 1 and 2 reference numeral 10 has been applied to indicate an electric plug type fuse according to the invention. The fuse includes a substantially cylindrical hollow glass insulating body 12. The glass body 12 defines an internal cavity 14 and is provided with a plurality of circumferentially extending threads 16. The lower end of the glass body 12 is open and is plugged by a contact button support 18 which is made from an electric insulating material such as, for instance, a synthetic resin. The upper end 22 of the contact button support 18 projects into the cavity 14 and the lower end 24 of the contact button support projects away from the cavity 14 to the outside of the fuse body. The contact button support 18 is provided with a circumferentially extending flange 20 which engages the lower end of the fuse body to position the contact button support with respect to the fuse body 12 as will be appreciated as the description continues.

A contact button 26 made from an electroconductive material is arranged in coaxial relation to and is affixed to a receiving opening 28 provided in the contact button support 18. A metal outer shell 46 is provided with screw threads 48 which mate with the screw threads 16 on the glass body 12 thereby allowing the metal shell to be threadably engaged with the glass body. The metal shell is provided with an inwardly extending circumferential portion 49, at its lower end, which engages the flange 20 of the contact button support 18 and thus holds the contact button support in position when the fuse is assembled.

The glass body 12 is provided with a groove 54 on its outer surface which extends perpendicular to and interrupts the screw threads 16 formed on the glass body. This groove 54 and the inner surface of the outer metal shell 46 cooperate to define an elongated channel 56 between them.

A fusible element 30 is formed from a strip like conductive material and has one end thereof 32 electroconductively connected to the inside of the contact button 26 by a solder connection 34. The fusible element extends from the conductive connection to the contact button into the cavity 14 defined by the glass body where a substantially horizontally extending section 36 is provided with an area of reduced cross section 31 as is well known in the art. The other end of the fusible element extends to a U-shaped section 38 which passes from the cavity 14 between the contact button support 18 and the glass body and into the channel 56 defined by the groove 54 and the metal shell. The end 40 of the fusible element 30 which extends into this channel is soldered to the interior surface of the metal shell 46 to complete the electrical conductive path of the fuse. A fusible element such as that described in U.S. Pat. No. 4,386,335 Electric Plug Type Fuse to O'Brien and Lechner may advantageously be used in connection with the present invention.

Figure 3:
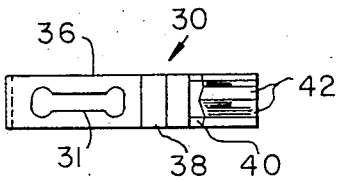
FIG. 3 plan view of a fusible element formed according to the present invention.
Figure 4:
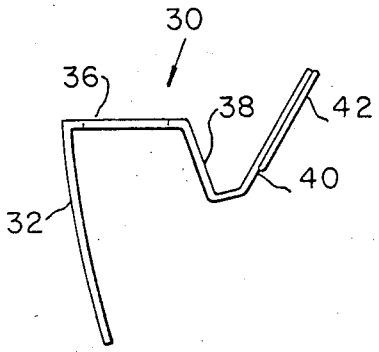
FIG. 4 is a vertical elevational view of the fusible element shown in FIG. 3.

As best shown in FIGS. 1 and 3 the end 40 of the fusible element 30 which extends into the channel 56 is formed into a geometric shape which may be described as a W-shaped or corrugated configuration. Looking now specifically at FIG. 1, the three surfaces which define the groove 54 in the glass body will be defined for reference in connection with the operation and advantages of the invention. Again with specific reference to the fuse as oriented in FIG. 1, the left hand, longer, surface of the groove 54 will be referred to as the "bottom" of the groove. The upper and lower surfaces of the groove 54 will hereinafter be referred to, respectively, as the upper and lower portions of the groove.

With continued reference to FIG. 1, it will be seen that the W-shaped portion 42 of the fusible element is specifically configured so that the element substantially fills the channel 56 defined by the groove 54 and the metal screw shell 46. More specifically, it will be seen that the ends of the W-shaped formation and the center V-bend of the formation are oriented so that they are received in the "bottom" of the channel 56. As a consequence, the two outer V-bends of the W-shape are oriented in close proximity to the metal shell 46. As a result of this configuration, it will be noted that the W-shape 42 of the fusible element and the metal shell 46 cooperate to define three substantially separate longitudinally extending solder receiving cells 58. As shown in FIGS. 1 and 2 the cells 58 are filled with solder 44 in order to achieve the electrical connection between the fusible element and the metal shell 46.

The configuration thus described is such that the end portions of the W-shaped or corrugated section 42 of the fusible element are received in the groove 54 at the line 60 defining the intersection between the "bottom" surface and "lower" surface of the groove 54. This arrangement results in optimum mechanical interlocking between the outer metal shell 46, the fusible element, and the glass body 12.

Referring again to FIG. 1, reference numeral 52 is applied to an arrow indicating the force on the insulating glass body when a fuse is removed from a fuse holder. Similarly arrow 50 indicates the force imparted to the metal screw shell 46 when a fuse is removed from a fuse holder. The optimum mechanical interlocking arrangement described hereinabove serves to very effectively transfer these forces and will not permit the corrugated element 42 to slip out of the groove 54 during removal from a fuse holder, and, as a result will prevent a potentially hazardous condition.

In addition to the above described superior mechanical interlock features of the invention, it should be noted that the geometric shape imparted to the end of the fusible element contained in the channel 56 also permits far easier soldering of the fusible element to the metal shell 46 as the solder receiving channels 58 serve to draw the solder into themselves thereby resulting in a more reliable solder bond to the screw shell. A greater surface area solder connection also results with such configuration, further contributing to a more reliable solder bond of the element and screw shell.

While the invention has been shown and described with respect to a W-shaped geometric formation 42 at the end of the fusible element extending into the channel 56, it should be appreciated that a V-shaped or C-shaped configuration, wherein the ends of the V- or C-shape formation are received in the "bottom" of the channel 56 and the apex of the V- or C-shape is in close proximity to the metal shell 46 provides all of the beneficial advantages of the invention. Further, a geometric configuration containing more corrugations than the W-shape formation could also advantageously be used according to the invention.

Accordingly it should be appreciated that an electric plug type fuse has been provided wherein an extremely thin fusible element may be utilized with the well known plug fuse construction wherein one end of the fusible element is soldered to an outer metal shell to achieve both an electrical and mechanical connection in the fuse. The present invention permits use of such extremely thin fusible elements in such a configuration while assuring good mechanical and electrical integrity in the resulting fuse construction.

This invention may be practiced or embodied in still other ways without departing from the spirit or essential character thereof. The preferred embodiments described herein are therefore illustrative and not restrictive, the scope of the invention being indicated by the appended claims and all variations which come within the meaning of the claims are intended to be embraced therein.

What is claimed is:

1. An electric plug type fuse including a substantially cylindrical hollow glass body defining a cavity and being screw threaded on the outer surface thereof, a contact button support of an electric insulating material of which one end projects into the cavity and the other end projects away from the cavity to the outside thereof, a contact button on the outer end of the contact button support, a metal shell overlapping the contact button support, the metal shell being screw threaded, and the screw threads thereof mating with the screw threads on the glass body, the glass body having a groove on the outer surface thereof extending perpendicular to and interrupting the screw threads on the glass body, the groove and the metal shell cooperating to define a channel therebetween, a strip-like fusible element having one end thereof conductively connected to the contat button and extending therefrom into the cavity defined by the glass body, the other end of the fusible element extending from the cavity, between the contact button support and the glass body into the channel defined by the groove and the metal shell, where the other end of the fusible element is soldered to the metal shell, wherein the improvement comprises:

forming said other end of said fusible element which extends into said channel into a geometric shape which defines a plurality of substantially separate longitudinal solder receiving cells in said channel between said fusible element and said metal shell.

2. The electric plug type fuse of claim 1 wherein said other end of said fusible element is formed into a V-shape and wherein the ends of the V-shape formation are received in the bottom of said channel and the apex of said V-shape is in close proximity to said metal shell.

3. The electric plug type fuse of claim 1 wherein said other end of said fusible element is formed into a W-shape and wherein the ends of the W-shape formation and the center V-bend are received in the bottom of said channel, and the outer V-bends of said W-shape are in close proximity to said metal shell.

* * * * *